US008393810B2

(12) United States Patent
Bandholz et al.

(10) Patent No.: US 8,393,810 B2
(45) Date of Patent: Mar. 12, 2013

(54) LABEL ROLL AND GUIDING SYSTEM

(75) Inventors: Brent A. Bandholz, Hubertus, WI (US); Richard L. Carriere, Oak Creek, WI (US); Robert J. Godfrey, Baraboo, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 557 days.

(21) Appl. No.: 12/482,819

(22) Filed: Jun. 11, 2009

(65) Prior Publication Data

US 2009/0311027 A1 Dec. 17, 2009

Related U.S. Application Data

(60) Provisional application No. 61/061,448, filed on Jun. 13, 2008.

(51) Int. Cl.

| | |
|---|---|
| ***B41J 15/00*** | (2006.01) |
| ***B65H 23/00*** | (2006.01) |
| ***B65H 57/18*** | (2006.01) |
| ***B65H 16/06*** | (2006.01) |
| ***B65H 18/04*** | (2006.01) |
| ***B65H 49/26*** | (2006.01) |
| ***B65H 49/32*** | (2006.01) |
| ***B65H 75/18*** | (2006.01) |

(52) U.S. Cl. ..... 400/613; 400/619; 242/566; 242/598.3

(58) Field of Classification Search ..... 400/619, 400/613; 242/548.3, 566, 598.3

See application file for complete search history.

(56) References Cited

U.S. PATENT DOCUMENTS

| | | | | |
|---|---|---|---|---|
| 5,435,658 | A | 7/1995 | Hasegawa | |
| 5,974,963 | A * | 11/1999 | Kawai | 101/128.1 |
| 6,431,492 | B1 | 8/2002 | Chillscyzn | |
| 6,609,844 | B1 | 8/2003 | Petteruti et al. | |
| 6,622,622 | B2 | 9/2003 | Lee et al. | |
| 6,695,500 | B2 | 2/2004 | Kim et al. | |
| 6,788,324 | B2 * | 9/2004 | Fisher et al. | 347/188 |
| 7,077,354 | B2 | 7/2006 | Saliba | |
| 7,104,712 | B2 | 9/2006 | Sugimoto et al. | |
| 2005/0214054 | A1 * | 9/2005 | Hoshino et al. | 400/613 |
| 2008/0003044 | A1 | 1/2008 | Sugimoto et al. | |

OTHER PUBLICATIONS

Protomold, "Designing for Moldability", © 2007.*

PCT International Search Report for PCT/US2009/047078 dated Sep. 16, 2009, 4 pages.

* cited by examiner

*Primary Examiner* — Judy Nguyen
*Assistant Examiner* — Blake A Tankersley
(74) *Attorney, Agent, or Firm* — Quarles & Brady LLP

(57) ABSTRACT

The present invention provides a media guide system for guiding media unwound from a roll of a roll assembly along a direction of roll feeding in a printer. The guide system includes a guide base including a datum edge guide surface and a plurality of edge guide receivers. The datum edge guide surface is aligned along a direction of roll feeding. The plurality of edge guide receivers is formed in the guide base and extends along the direction of roll feeding. When the roll assembly is loaded into the guide base by engaging an edge guide of the roll assembly into at least one of the plurality of edge guide receivers, the datum edge guide surface of the guide base and the edge guide of the roll assembly serve as edge guides to guide the roll through the printer during a printing operation.

20 Claims, 11 Drawing Sheets

LABEL ROLL AND GUIDING SYSTEM

CROSS-REFERENCE TO RELATED APPLICATION

This application claims the benefit of U.S. Provisional Patent Application No. 61/061,448 filed Jun. 13, 2008, the disclosure of which is hereby incorporated by reference in entirety.

STATEMENT OF FEDERALLY SPONSORED RESEARCH OR DEVELOPMENT

Not applicable.

BACKGROUND OF THE INVENTION

This invention relates to printers. In particular, this invention relates to thermal transfer printers for the printing of labels.

Printers, such as thermal transfer printers, can be used to print labels. Commonly, during the printing operation, a release liner carries the labels past a print head which prints information, such as a barcode or text, onto each label. After the information is printed onto the label, then the label can be removed from the release liner and applied to its target.

For convenience, these labels are often sold in rolls that can be inserted into a dedicated label printer. However, the printing on rolls of labels may present a number of challenges.

First, to ensure that the printing is contained on the label surface, the release liner must be accurately guided through the printer. In the case of a printer that is dedicated to printing labels on a release liner having a particular width, it is relatively straightforward to provide fixed guides of an appropriate width. However, for economy, it is desirable that most printers be able to print to labels on release liners having a variety of widths. Although some printers provide adjustable guides to accommodate a variety of widths, the adjustable guides may move during the printing operation and may still allow for some skewing of the print on the labels. Moreover, the operator must remember to move the guides to the correct position if they are to work in any capacity.

Additionally, loading a roll into a printer can be a cumbersome task, since many printers are small in form and lack ample space for hands. The loading operation may require feeding the roll through internal guides as well as into a space between a platen roller and print head. Direction as to the location and the adjustment of the internal guides and how to feed the labels through the internal guides (i.e., the orientation of the labels) is often poorly communicated. Accordingly, the loading of many printers can be an exercise in patience.

Hence, a need exists for an improved guide system in a printer that can print on rolls of various widths. In particular, a need exists for a guiding system that reduces the frustration of loading and guiding a roll though a printer.

SUMMARY OF THE INVENTION

The present invention provides a media guide system for guiding media unwound from a roll of a roll assembly along a direction of roll feeding in a printer. The roll of the roll assembly is supported by a core extending from one core end to an edge guide. The guide system includes a guide base having a datum edge guide surface and a plurality of edge guide receivers. The datum edge guide surface is aligned along the direction of roll feeding. The plurality of edge guide receivers is formed in the guide base and extends along the direction of roll feeding. When the roll assembly is loaded into the guide base by engaging the edge guide into at least one of the plurality of edge guide receivers, the datum edge guide surface of the guide base and the edge guide of the roll assembly serve as edge guides to guide the roll through the printer during a printing operation.

According to one aspect of the invention, the guide base further includes an end cap fixed on the end of the core and an end cap receiver for receiving the end cap of the roll assembly. The end cap receiver may be located on a side wall of the guide base. When the end cap is placed into the end cap receiver to support the roll assembly, the core may extend away from the end cap receiver in a direction orthogonal to the datum edge guide surface. In one form, the end cap receiver has a slot having ribs that can mate with a groove in the end cap.

According to another aspect of the invention, the guide system further includes the roll assembly after the roll assembly is received in the guide base. The media may include a release liner having labels placed thereupon for printing.

According to yet another aspect of the invention, the plurality of edge guide receivers are a series of grooves having ribs therebetween. The series of grooves may have a portion that narrows proximate the datum edge guide surface to define a distance between the datum edge guide surface and the edge guide when the roll assembly is loaded into the printer. The plurality of edge guide receivers may be essentially parallel to one another. Additionally, the plurality of edge guide receivers may be formed in a surface that is orthogonal to the datum edge guide surface.

According to other aspects of the invention, the datum edge guide surface may be located proximate a platen roller in the guide base. The datum edge guide surface may be fixed relative to the plurality of edge guide receivers. The guide base may further include a rear stop. The rear stop may be configured to support a portion of the edge guide of the roll assembly. The guide system may further include a slot for feeding the roll out of the guide base. Additionally, the printer may be a thermal transfer printer. According to yet another aspect of the invention, the guide system may further include an upper print frame containing a print head proximate a platen roller in the guide base when the upper print frame is in a closed position. The upper print frame may be adjustable relative to the guide base to lift the print head from the platen roller and to move the upper print frame into an opened position. When the upper print frame is moved into the opened position, the guide base is exposed such that the roll assembly can be loaded into the guide base, a portion of the roll can be extended over the platen roller, and the upper print frame can be returned to the closed position to sandwich the roll between the print head and the platen roller. The upper print frame may have a portion for selective coupling to a top of the edge guide of the roll assembly when print frame is in the closed position such that the roll assembly is secured within the print frame to prevent movement of the roll assembly within the print frame.

Thus, the present invention provides a guide system in a printer for receiving a label roll assembly that is easily loaded and can guide the roll through the printer when loaded. The guide system accommodates for the guidance of multiple widths of rolls without adjustable guides. Moreover, according to some forms of the invention, the guide system does not require the threading of the roll between a print head and platen roller during the loading process.

These and still other advantages of the invention will be apparent from the detailed description and drawings. What follows is merely a description of a preferred embodiment of the present invention. To assess the full scope of the invention, the claims should be looked to as the preferred embodiment is not intended to be the only embodiment within the scope of the claims.

DETAILED DESCRIPTION OF THE PREFERRED EMBODIMENT

Figure 1:
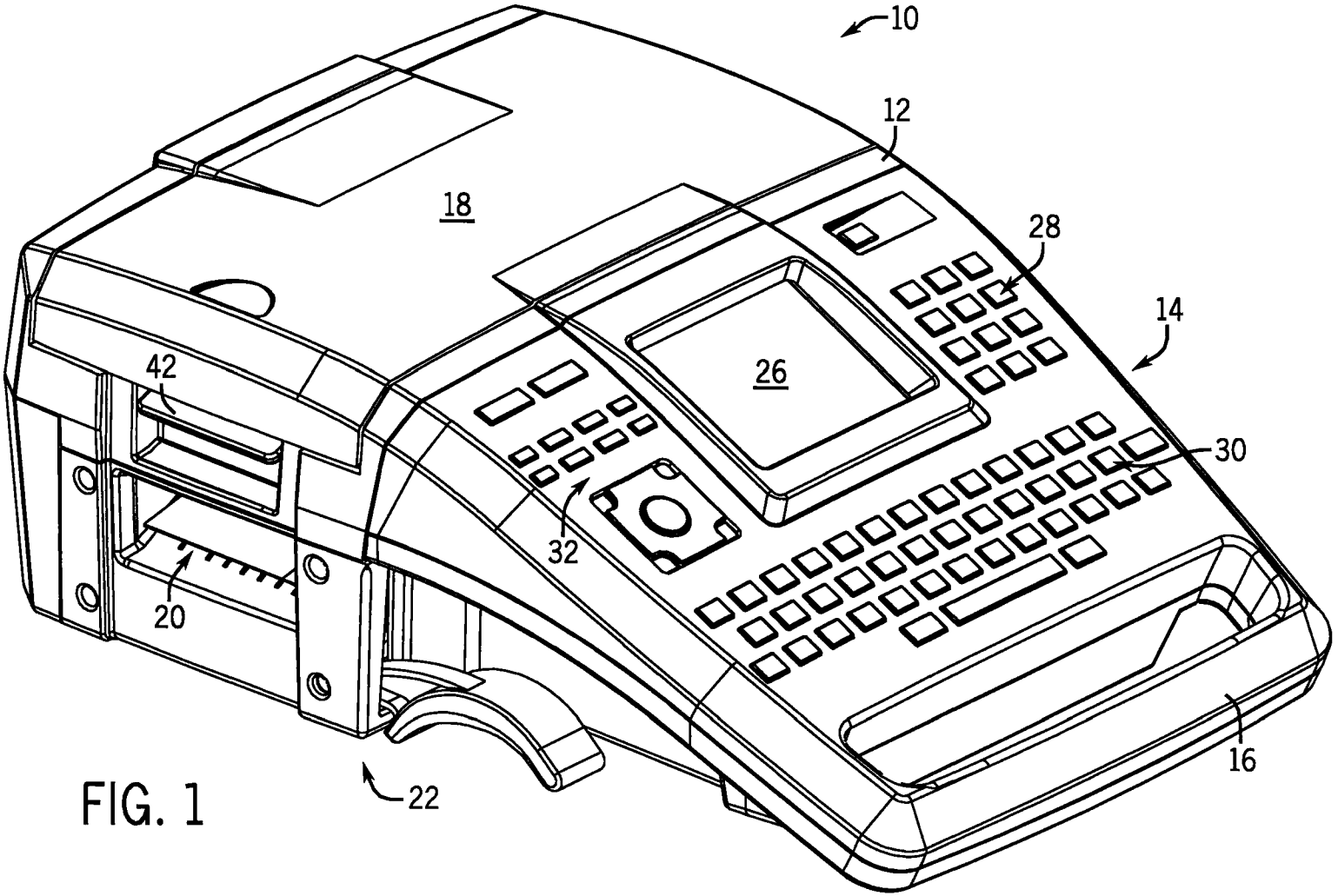
FIG. 1 is a front side perspective view of a printer.

Referring now to FIG. 1, a printer 10 incorporating the present invention for the printing of labels is shown. The printer 10 has a body 12 including a user interface 14, a handle 16 for easy transport of the printer 10, a moveable cover 18 for accessing a print assembly transversely mounted within the body 12 of the printer 10, a print slot 20 that dispenses the printed labels out of the printer 10, and a cutting assembly 22 for the cutting or separation of printed labels. It should be appreciated that the printer 10 may be operable when oriented in directions other than that shown in FIG. 1. For example, the printer 10 may be placed on its side or with the handle 16 directed up.

The user interface 14 allows the user to input data for printing on a label and commands for controlling the printer 10. The user interface 14 may include, but is not limited to, a display 26 for the display of entered data or prompting of user input, a keypad 28 and a keyboard 30 for entering data, and function buttons 32 that may be configured to perform various functions typical to printing (i.e., power on/off, forward feed, stop printing, and the like) or can be programmable for the execution of user-defined macros.

The user interface 14 may be supplemented by or replaced by other forms of data entry or printer control. For example, a separate data entry and control module may be linked wirelessly or by a data cable to the printer 10. The data entry and control module can include a computer, a router, and the like, without departing from the scope of the invention.

Figure 2:
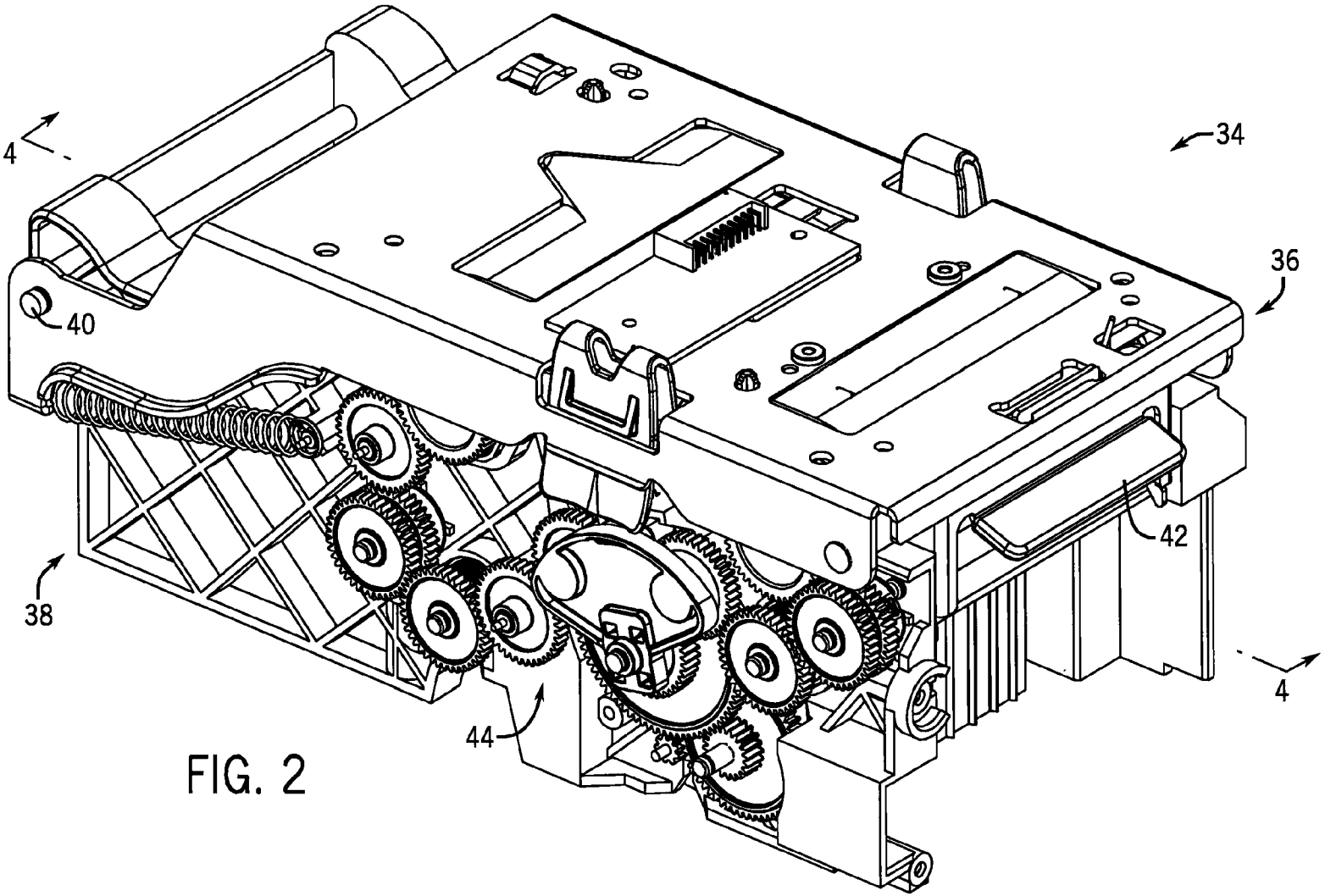
FIG. 2 is a perspective view of a print assembly contained within the printer of FIG. 1 with the print assembly in a closed position.

Referring now to FIG. 2, a print assembly 34 is shown after having been removed from the inside of the printer 10. In the form shown, this print assembly 34 is mounted transversely in the printer body and includes an upper print frame 36 and a lower print frame 38. On the rear side of the print assembly 34, the upper print frame 36 and the lower print frame 38 are pivotally connected at a hinge 40. On the front side of the print assembly 34, a latch 42 releaseably secures the upper print frame 36 and the lower print frame 38 together.

The print assembly 34 can be in an opened or a closed position. In the view shown in FIG. 2, the print assembly 34 is in the closed position. In this view, the upper print frame 36 and the lower print frame 38 are held together by the hinge 40 on one side and the latch 42 on the other side. In the view shown in FIG. 3, the print assembly is in the opened position. In this position, the latch 42 is released such that the upper print frame 36 and the lower print frame 38 can be moved apart from one another to provide easy access to the internal components of the print assembly 34. It should be noted that while a hinged assembly has been described, that other structures for holding an upper print frame to a lower print frame are contemplated.

In some forms of the invention, the upper print frame 36 may be secured to the moveable cover 18 and the latch 42 may be accessible from the exterior of the printer 10. In this way, when the latch 42 is released to allow the upper print frame 36 to pivot relative to the lower print frame 38, the upper print frame 36 and the moveable cover 18 move together so as to minimize the steps necessary to open the printer 10 and access the interior for the replacement of consumables or other maintenance operations.

Figure 3:
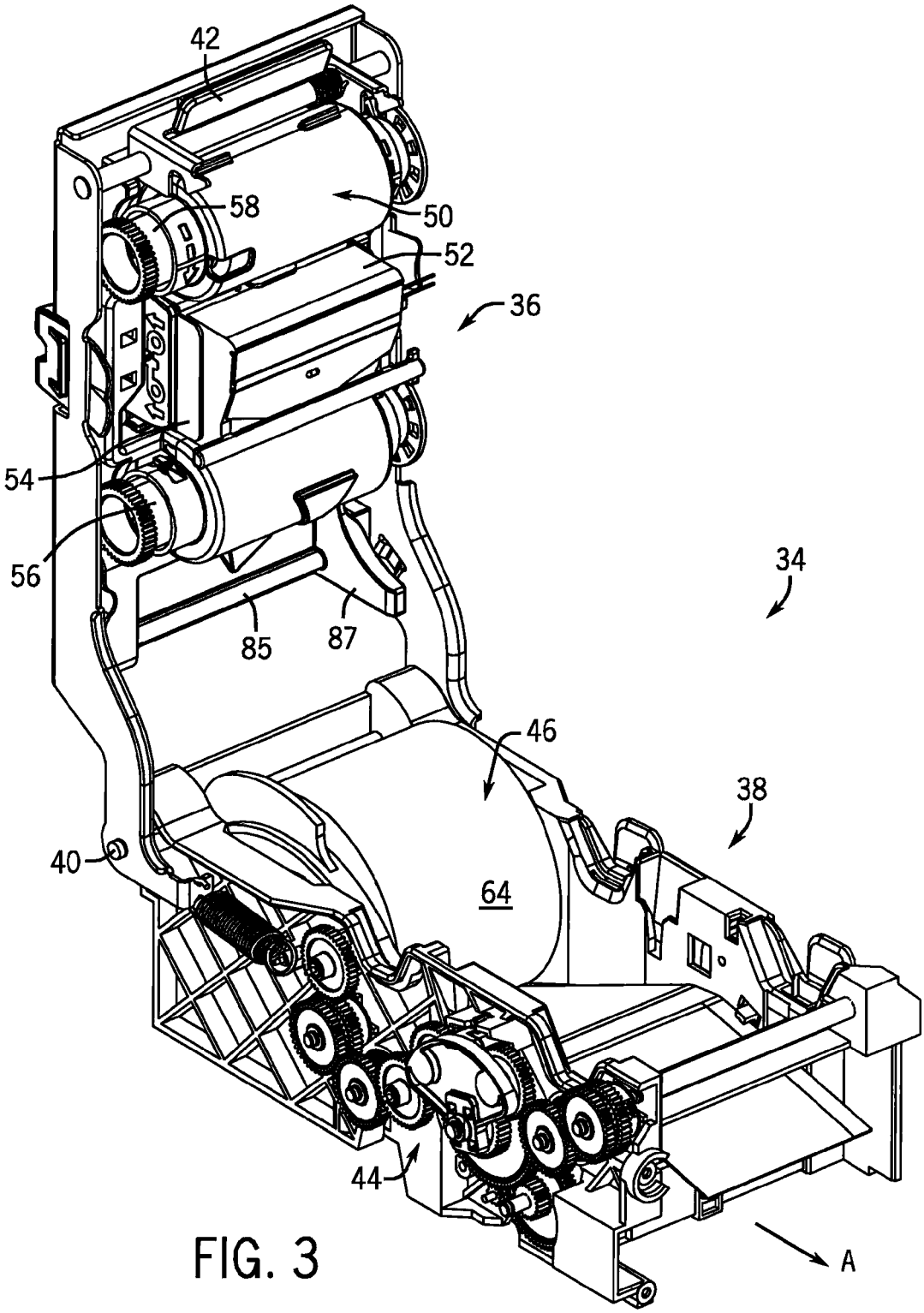
FIG. 3 is a perspective view of the print assembly of FIG. 2 in an opened position.

Referring now to FIG. 3, the print assembly 34 is shown after the latch 42 has been released to allow the upper print frame 36 to pivot away from the lower print frame 38, thus moving the print assembly 34 into the opened position and exposing the interior of the print assembly 34. On the inside of the print assembly 34, a roll assembly 46 has been loaded into the lower print frame 38. The roll assembly 46 carries a print media, such as, for example, labels, thereupon.

In the opened position, the internal components attached to the upper print frame 36 can also be seen. Attached to the upper print frame 36 are a bracket 54 having a print head 52 moveably coupled thereto and a ribbon cartridge 50. The ribbon cartridge 50 includes a supply spool 56 and a take-up spool 58 that can have a ribbon (not shown), such as an ink ribbon, extending therebetween. The ribbon cartridge 50 may be selectively driven by a gear train 44 or another motive element to feed the ribbon between the two spools 56, 58.

The print head 52 is located between the two spools 56, 58 such that the ribbon passes across the print head 52 for a printing process, such as, for example, thermal transfer printing in which the ink on the ribbon is selectively melted to the print media. If the print head is a thermal transfer print head, then the print head 52 may include heating elements allowing for the selective heating of the print head 52, associated control circuitry, a heat sink for the dissipation of the heat from the print head 52, and the like.

Figure 4:
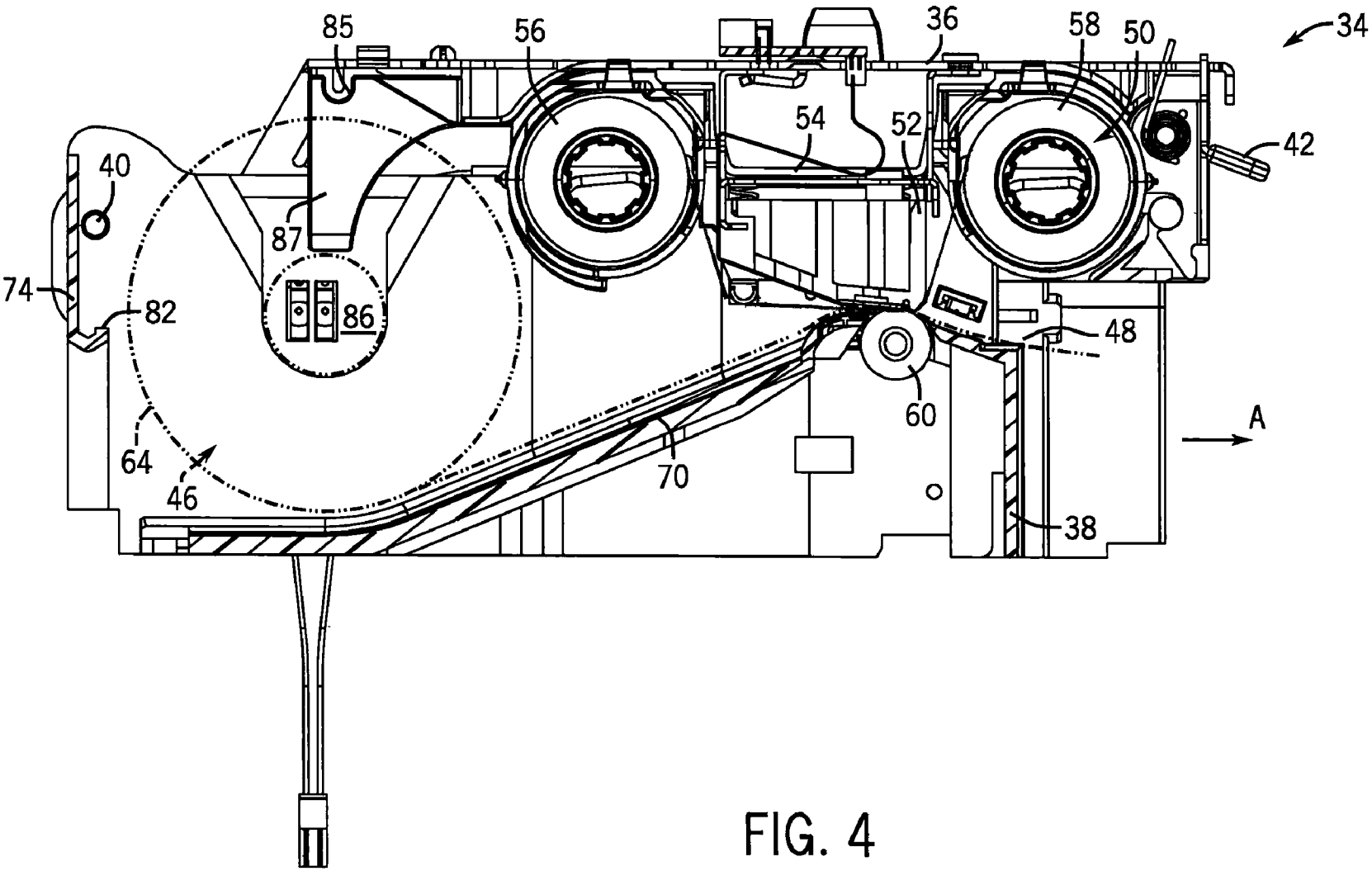
FIG. 4 is a cross-sectional view along line 4-4 of FIG. 2.
Figure 5:
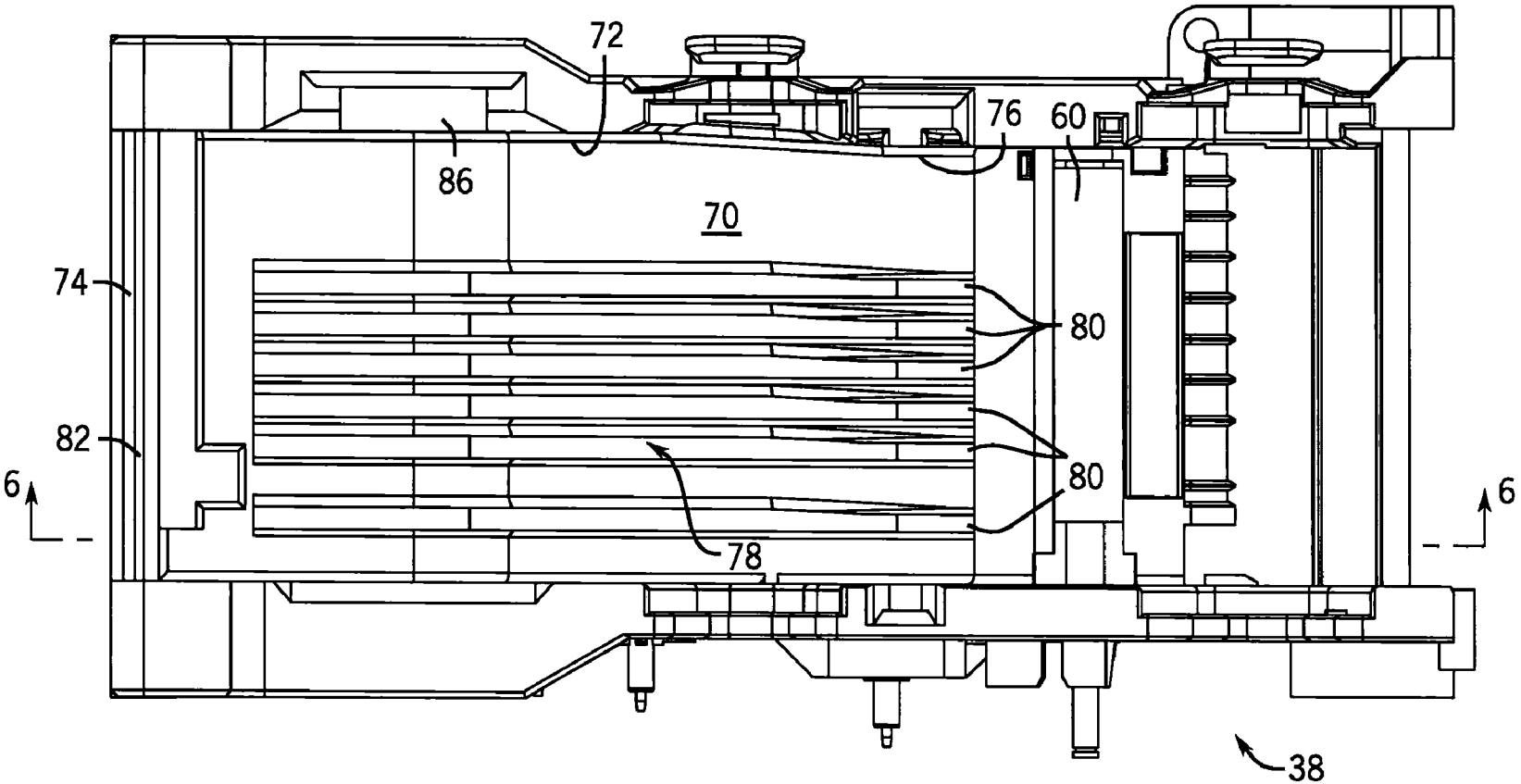
FIG. 5 is a top plan view of the guide base.
Figure 6:
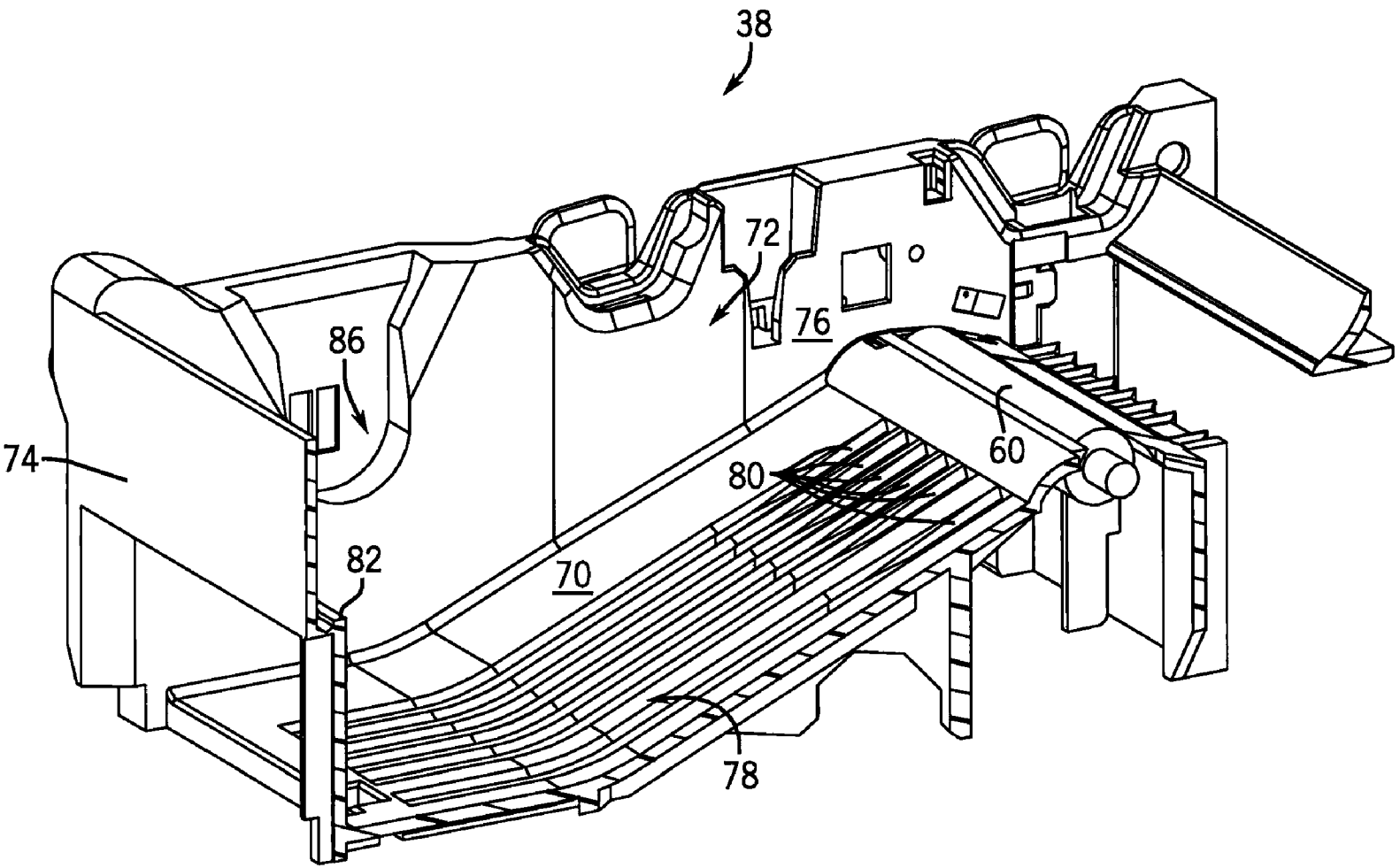
FIG. 6 is a cross-sectional view along line 6-6 of FIG. 5.

Referring now to FIG. 4, a cross-sectional view of the print assembly 34 is shown with the print assembly 34 in the closed position and the print media fed through the print assembly 34 in phantom lines. As can be seen in this view, when the print assembly 34 is closed, the print head 52 is biased away from the bracket 54 to apply pressure across a platen roller 60 located in the lower print frame 38. When the print media on the roll assembly 46 and the ribbon are fed between the print head 52 and the platen roller 60 by the rotation of the platen roller 60, the print head 52 applies a pressure across the ribbon and print media and can be selectively heated to transfer the ink on the ribbon to the print media. After the media has been printed on, the media is fed out a slot 48 located on the side of the print assembly 34.

The gear train 44, mounted on the side of the lower print frame 38 and driven by a motor (not shown), drives the printing operation. Specifically, the gear train 44 drives the rotation of the platen roller 60 for feeding the media and the spools 56, 58 of the ribbon cartridge 50 for feeding the ribbon.

Due to the consumable nature of the printing process, many of the components in or attached to the print assembly 34 may be replaceable. For example, as the roll assembly 46 and the ribbon cartridge 50 are consumed during the printing process, it may be necessary to replace them from time to time. Thus, it may be beneficial to have easy access to the internal components of the print assembly 34.

The lower print frame 38 serves as a guide base for receiving the roll assembly 46, as can be seen in FIGS. 5-8. Although in the present embodiment, the lower print frame 38 of the printer 10 serves as the guide base, it should be appreciated that components other than a lower print frame can have the structure to perform as a guide base as will be described below. Thus, the present invention should not be limited to configurations in which the lower print frame 38 is the guide base.

Figure 7:
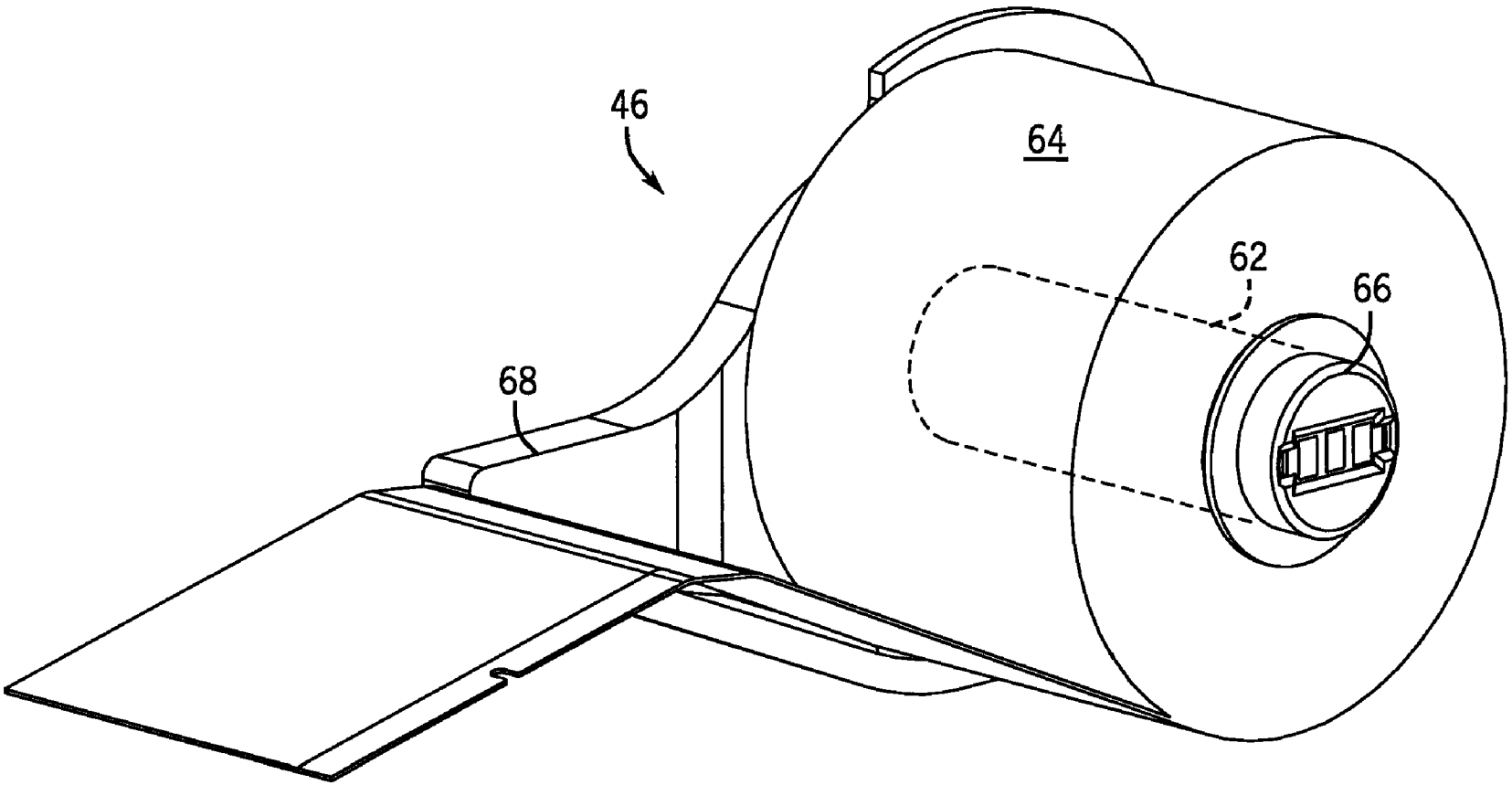
FIG. 7 is a front perspective view of the roll assembly.
Figure 8:
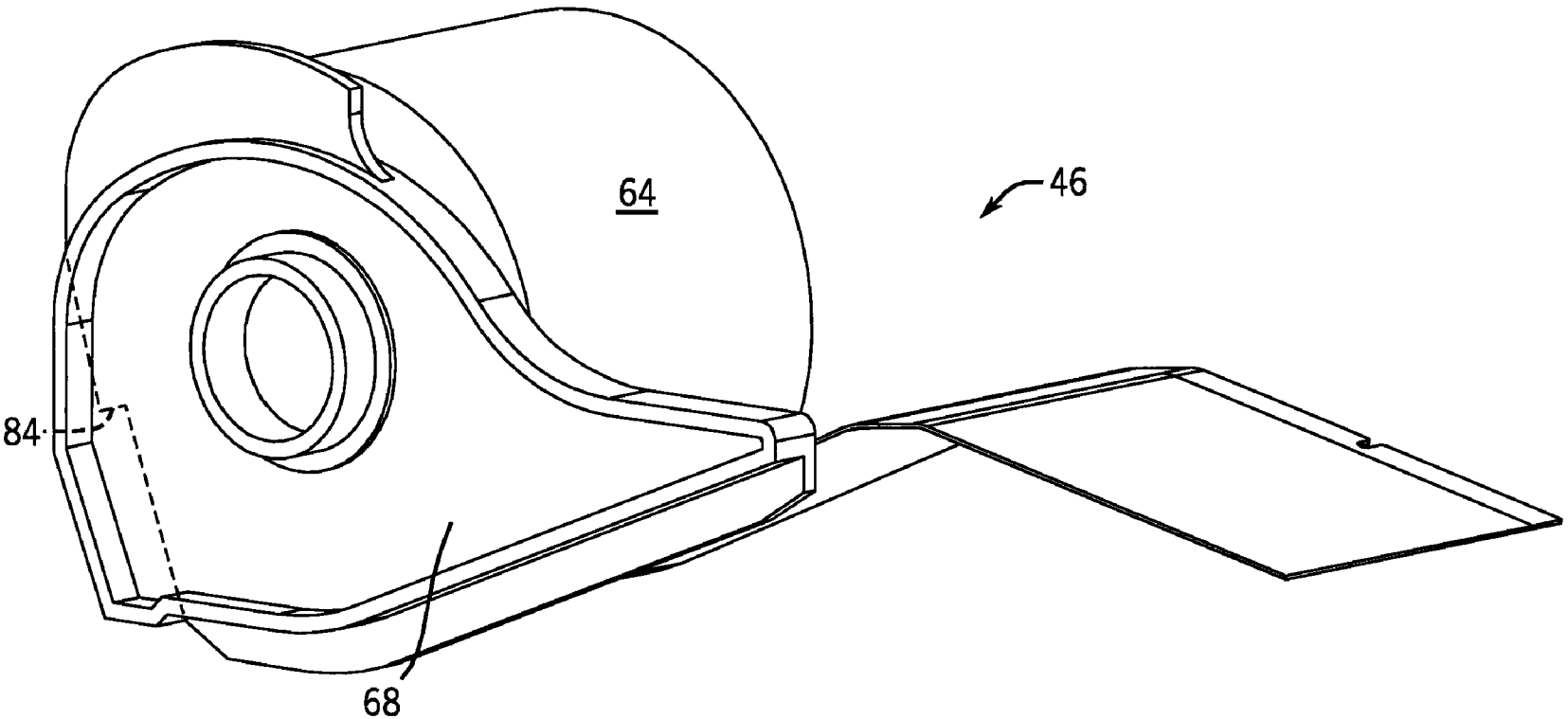
FIG. 8 is side perspective view of the roll assembly.

Referring first to FIGS. 7 and 8, the roll assembly 46 is shown. The roll assembly 46 includes a core 62 supporting a roll 64. The roll 64 can rotate with respect to the core 62 to dispense the print media, such as labels placed upon a release liner, during the printing operation. The core 62 extends from an end cap 66 on one side of the core 62 to an edge guide 68 on the other side of the core 62. Although the core 62 is shown as ending at the edge guide 68, it could continue through the edge guide 68 to another end (not shown).

Referring back to FIGS. 5 and 6, the lower print frame 38 has a structure that make it suitable for functioning as a portion of an edge guide for the media and for receiving the roll assembly 46.

In general form, the lower print frame 38 includes a bottom wall 70, a lateral wall 72, and a rear wall 74. The lateral wall 72 and the rear wall 74 extend orthogonally from the bottom wall 70.

A datum edge guide surface 76 located on a portion of the lateral wall 72 serves as one of two edge guide surfaces for guiding the print media through the print assembly 34 and, in particular, past the print head 52. The datum edge guide surface 76 extends in a direction parallel to the direction of roll feeding (indicated by the arrow A in FIGS. 3 and 4) through the print assembly 34 and is orthogonally aligned relative to the core 62 of the roll assembly 46 when the roll assembly 46 is received into the guide base. As shown, the datum edge guide surface 76 on the lateral wall 72 is proximate the platen roller 60 which extends across the bottom wall 70 of the guide base.

Notably, in the embodiment herein, the datum edge guide surface 76 is a fixed portion of the guide base and, thus, is not adjustable. Furthermore, although the datum edge guide surface is shown as being integrally formed with the guide base, the datum edge guide surface 76 does not necessarily need to be integrally formed with the rest of the guide base. Moreover, the datum edge guide surface 76 can be adjustable without departing from the scope of the invention.

Additionally, a plurality of edge guide receivers 78 are formed in the top surface of the bottom wall 70 of the guide base. The plurality of edge guide receivers 78 extend along the direction of roll feeding. As shown, the plurality of edge guide receivers 78 are essentially parallel to one another. The plurality of edge guide receivers 78 can be, as shown, a series of grooves having ribs therebetween. The series of grooves may have a narrow portion 80 that narrows as the series of grooves approach the platen roller 60.

Figure 9:
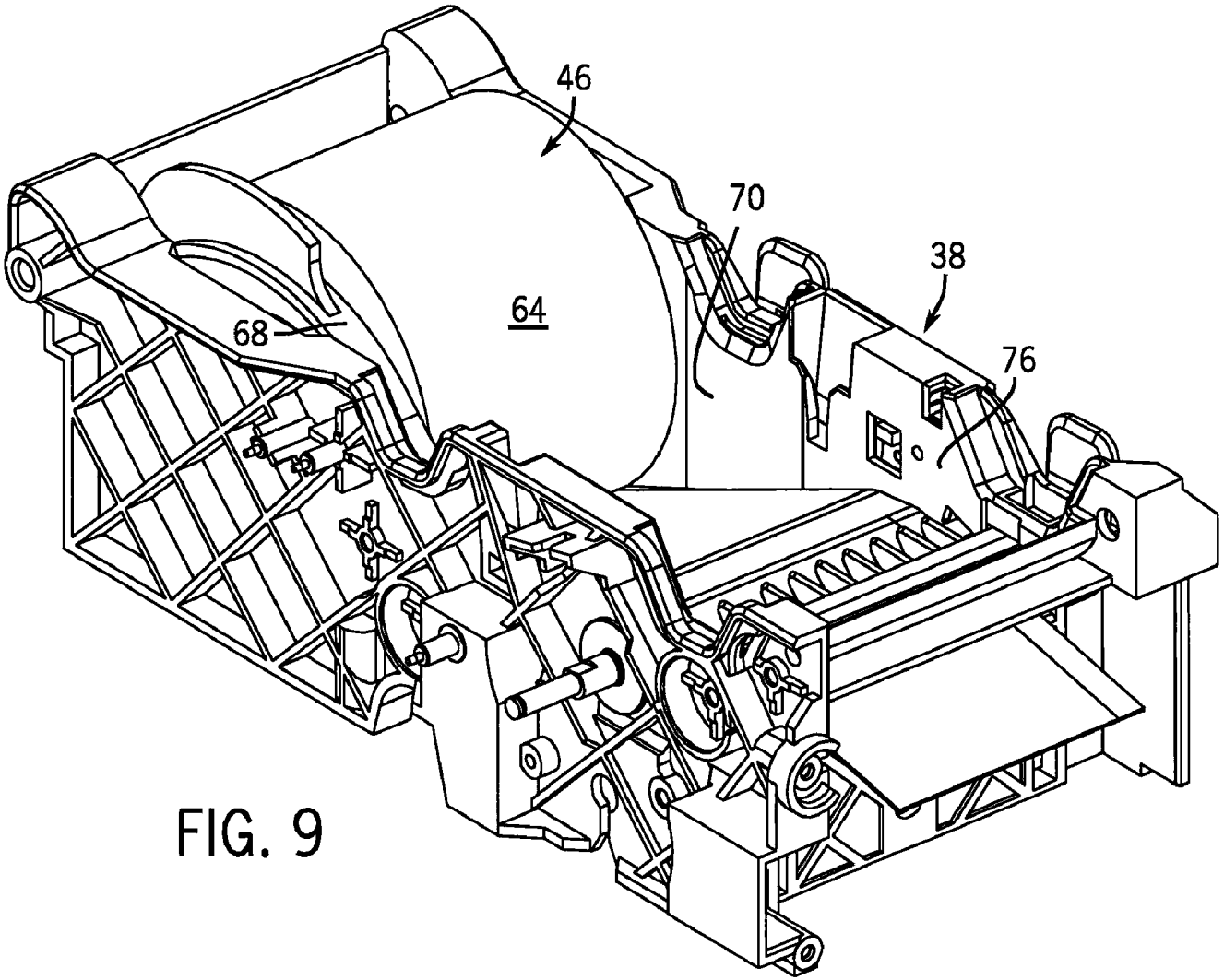
FIG. 9 is a front perspective view of the roll assembly in the guide base.
Figure 10:
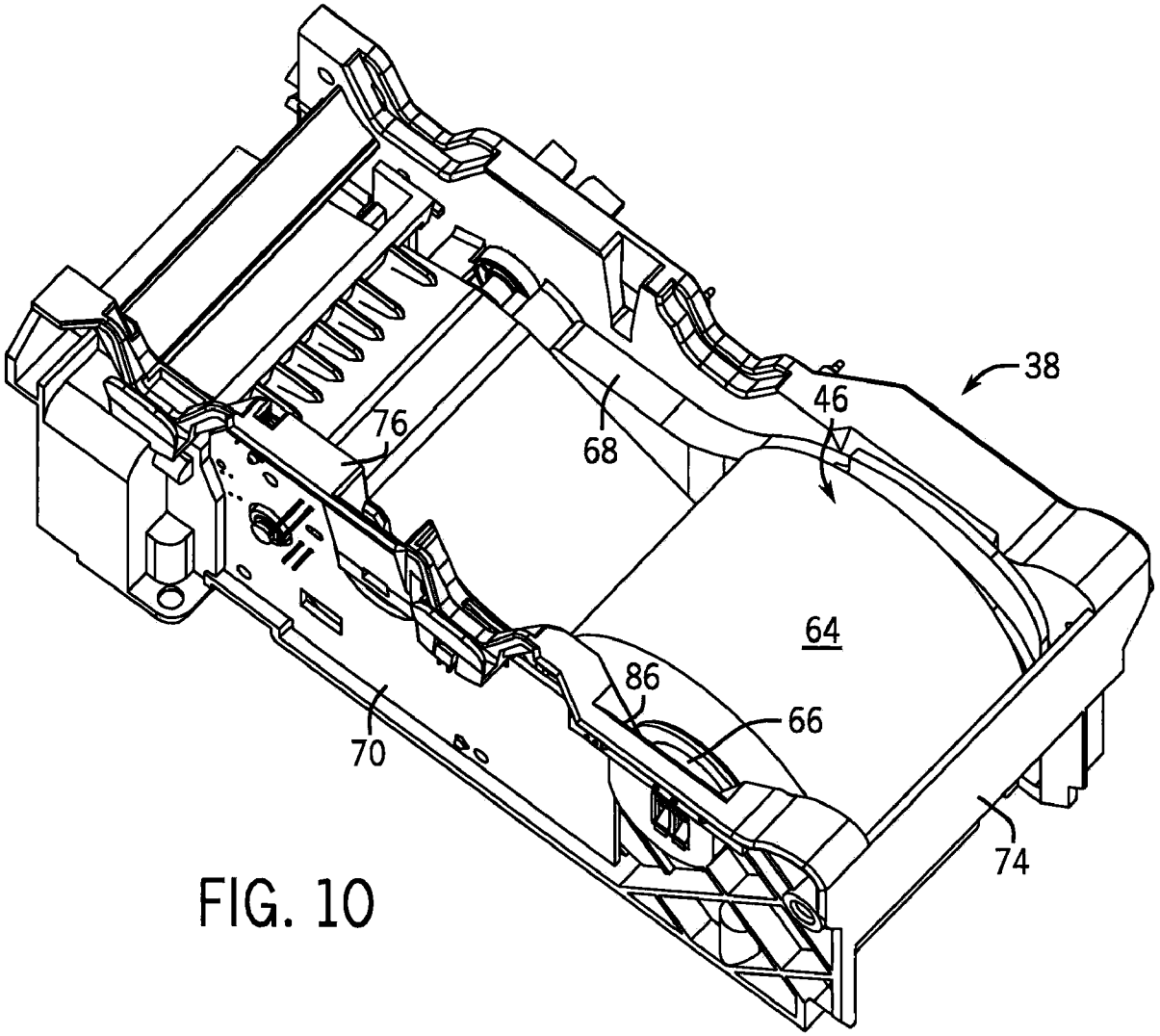
FIG. 10 is a top perspective view of the roll assembly as inserted in the guide base.
Figure 11:
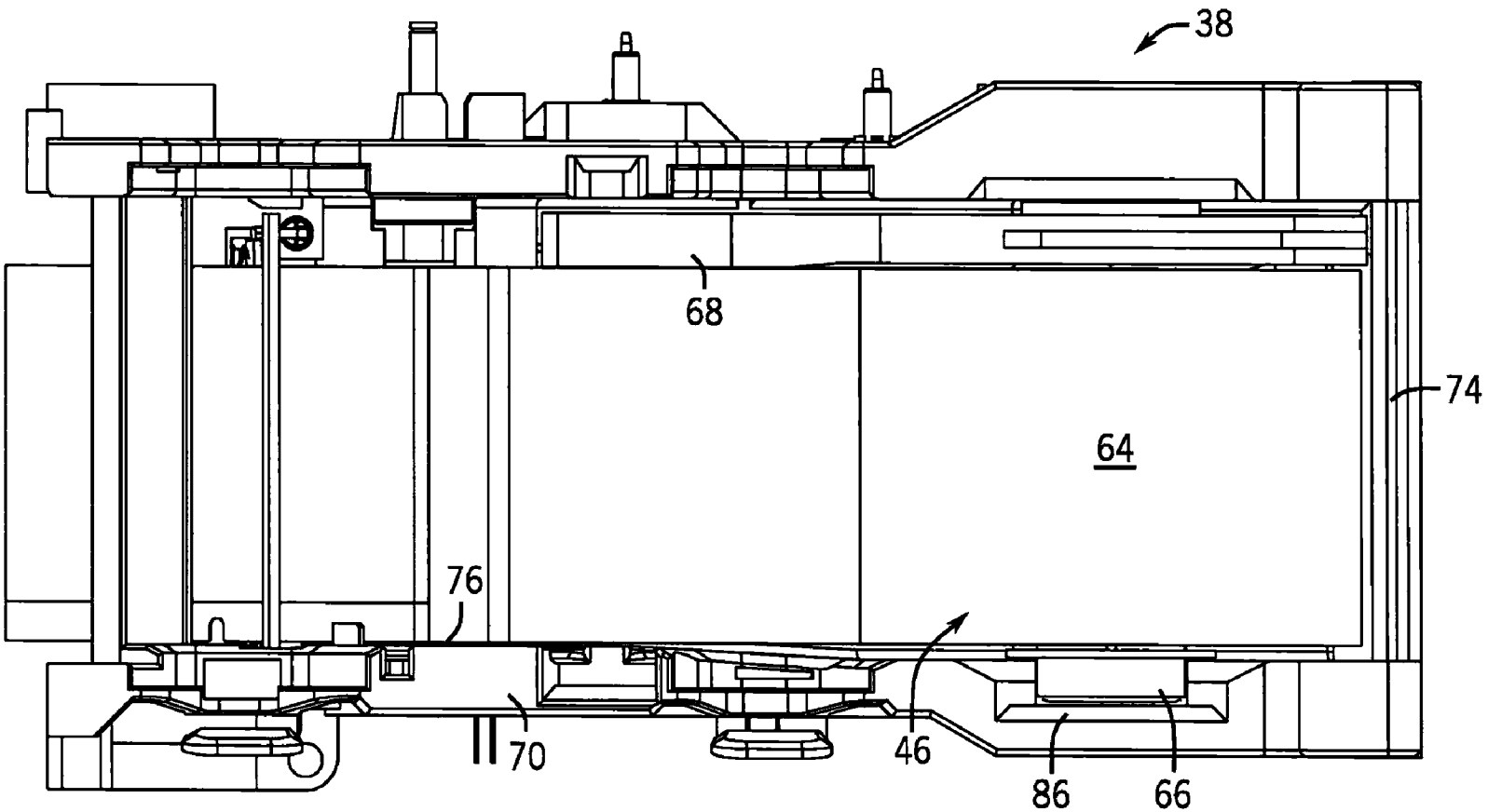
FIG. 11 is a top plan view of FIG. 10.

Upon insertion of the edge guide 68 in at least one of the plurality of edge guide receivers 78 in the guide base, as shown in FIGS. 9-11, the edge guide 68 becomes the second edge guide surface. Thus, when the roll 64 is fed through the print head 52, it is guided by the datum edge guide surface 76 on one side and the edge guide 68 on the roll assembly 46 on the other side.

Preferably, there are no adjustable guides, as one of the edge guides is fixed (the datum edge guide surface 76) and the positioning of the other edge guide (the edge guide 68) is determined during the loading process of the roll assembly 46. Thus, there is no need to communicate instructions to the user about how to adjust the guides. Moreover, there is no possibility that the user will forget to adjust the guides on loading, since the only non-fixed guide is positioned during the loading process.

Moreover, as there are a plurality of edge guide receivers 78, the guide system is capable of accommodating for roll assemblies with rolls having a variety of widths. It is contemplated that each of the plurality of edge guide receivers 78 can provide a corresponding discrete guide width (that in turn corresponds to the guide widths for standard print media) once the edge guides on the roll assemblies are inserted. However, it is also possible that the edge guides 68 can be formed to provide intermediate guide widths for intermediate roll widths (by building up material on the edge guide 68).

In addition to the engagement of the edge guide 68 into at least one of the plurality of edge guide receivers 78, the roll assembly 46 can be more closely located and positioned within the guide base in a number of ways.

The narrow portion 80 of the plurality of edge guide receivers 78 may be used to more precisely define the guide width in the region of printing (i.e., near the print head 52 and the platen roller 60). For example, the narrow portions 80 and the portion of the edge guide 68 that is inserted into the narrow portions 80 may have tighter tolerances to provide a snug fit between the edge guide receiver 78 and the edge guide proximate the region of printing. To improve guiding near the region of printing, it is also desirable to locate the datum edge guide surface 76 proximate the print head 52 and the platen roller 60.

Additionally, the rear wall 74 of the guide base may provide a locating and/or a supporting function. The rear wall may have a rear stop 82, step or other feature to support or that supports a mating feature 84 on the edge guide 68. This may restrict the forward and backward movement of the roll assembly 46 and prevent the roll assembly 46 from kicking up due to friction between the roll 64 and the core 62 during printing.

The upper print frame 36 may also have a protrusion 85 or other locating feature. When the upper print frame 36 is lowered, the protrusion 85 may engage a top portion of the edge guide 68 to secure the roll assembly 46 in the print assembly 34, regardless of the orientation of the printer 10.

An end cap receiver 86 is also formed in the lateral wall 72 to support and locate the core 62 holding the roll 64. In one form, the end cap receiver 86 is a slot having two ribs. In this form, the end cap 66 may have a groove that mates with the two ribs in the slot of the end cap receiver 86. In another form, the end cap 66 may be inserted into the end cap receiver 86 and held in the end cap receiver by a retention tab 87 attached to the upper print frame 36. When the print assembly 34 is open the retention tab 87 swings away from the end cap receiver 86 so that end cap 66 of the roll assembly 46 can be inserted into the end cap receiver 86. When the print assembly 34 is closed with the roll assembly 46 inserted, then the retention tab 87 descends to retain the end cap 66 in the end cap receiver 86 such that the roll assembly 46 is secured within the print assembly 34. In this form, it is contemplated that a slot and groove connection may be unnecessary.

In still yet another form, the core 62 may extend through the edge guide 68 to another end cap that is also received in an end cap receiver in the other lateral wall of the base. In this form, the other end cap also assists in supporting the core 62 and aligning the edge guide 68 in the corresponding edge guide receiver 78.

When the end cap 66 of the roll assembly 46 is placed into the end cap receiver 86 of the guide base, the core 62 of the roll assembly 46 extends away from the end cap 66 in a direction orthogonal to the datum edge guide surface 76. In this way, it can be ensured the direction of roll feeding is parallel to the datum edge guide surface 76 such that the print media is fed relatively straightly into the guides. Moreover, the reception of the end cap 66 in the end cap receiver 86 provides additional support for the roll assembly 46 in the guide base and reduces the likelihood of the roll assembly 46 skewing during printing.

It should be appreciated that the edge guide 68 may be formed such that the user can only insert the edge guide 68 into the proper edge guide receiver 78 for the width of the print media. This may be achieved by building up material 67 on the side of the edge guide 68 opposite the roll 64 that approaches (or even contacts) the side wall that does not have the datum edge guide surface 76. In this way, the roll assembly 46 may be structurally prevented from having its edge guide 68 received in an improper edge guide receiver 78. Alternatively, the profiles of the edge guide receivers 78 may be uniquely formed to only receive a matching edge guide 68 (e.g., of a particular width or length). These, and other ways of restrictive insertion, can prevent the user from improperly inserting the roll assembly 46 in the print assembly 34.

It should be appreciated that in the embodiment shown, loading of the roll assembly 46 is easier than in many thermal printers. Because the print head is mounted to the upper print frame 36, when the print assembly 34 is opened, the print head 52 is lifted from the platen roller 60 to expose the lower print frame 38 or guide base. Once the guide base is exposed, it is easy to load the roll assembly 46 into the print assembly 34. In particular, the print media of the roll can be extended over the platen roller 60, such that when the upper print frame 36 is returned to the closed position, the print head 52 and the platen roller 60 sandwich the print media on the roll 64. In this way, it is unnecessary to have the user attempt to feed the roll 64 between the print head 52 and the platen roller 60, which can be a frustrating task in the confined space of a printer.

While the preferred embodiment has been described as a printer suitable for printing onto labels on a release liner, the guide system described herein is suitable for any type of guiding system that requires the feeding of rolls that may have one of a number of widths.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

Industrial Applicability

The invention provides a guide system for the feeding of print materials through a printer.

What is claimed is:

1. A media guide system for guiding media unwound from a roll of a roll assembly along a direction of roll feeding in a printer, the roll assembly having the roll supported by a core extending from one core end to an edge guide, the guide system comprising:

a guide base including:

a datum edge guide surface provided at a position along the direction of roll feeding; and a plurality of edge guide receivers formed in the guide base and extending continuously along the direction of roll feeding to the position along the direction of roll feeding at which the datum edge guide surface is provided; and the roll assembly, wherein, when the roll assembly is loaded into the guide base by engaging the edge guide into at least one of the plurality of edge guide receivers, the datum edge guide surface of the guide base and the edge guide of the roll assembly serve as edge guides to guide the media unwound from the roll through the printer during a printing operation, and wherein the plurality of edge guide receivers extend continuously along the direction of roll feeding from an axis of the roll of the roll assembly, when the roll assembly is loaded into the guide base, to the position along the direction of roll feeding at which the datum edge guide surface is provided.

2. The media guide system of claim 1, in which an end cap is fixed on the end of the core and wherein the guide base further comprises an end cap receiver for receiving the end cap, the end cap receiver being located on a side wall of the guide base.

3. The media guide system of claim 2, wherein when the end cap is placed into the end cap receiver, the core extends away from the end cap receiver in a direction orthogonal to the datum edge guide surface.

4. The media guide system of claim 2, wherein the end cap receiver is a slot having ribs for mating with a groove in the end cap.

5. The media guide system of claim 1, further comprising the roll assembly received in the guide base.

6. The media guide system of claim 5, wherein the media includes a release liner having labels placed thereupon for printing.

7. The media guide system of claim 1, wherein the plurality of edge guide receivers are a series of grooves having ribs therebetween.

8. The media guide system of claim 7, wherein the series of grooves have a portion that narrows proximate the datum edge guide surface to define a distance between the datum edge guide surface and the edge guide when the roll assembly is loaded into the printer.

9. A media guide system for guiding media unwound from a roll of a roll assembly along a direction of roll feeding in a printer, the roll assembly having the roll supported by a core extending from one core end to an edge guide, the guide system comprising:

a guide base including:

a datum edge guide surface provided at a position along the direction of roll feeding; and a plurality of edge guide receivers formed in the guide base and extending continuously along the direction of roll feeding to the position along the direction of roll feeding at which the datum edge guide surface is provided; and the roll assembly, wherein, when the roll assembly is loaded into the guide base by engaging the edge guide into at least one of the plurality of edge guide receivers, the datum edge guide surface of the guide base and the edge guide of the roll assembly serve as edge guides to guide the media unwound from the roll through the printer during a printing operation, wherein the plurality of edge guide receivers are a series of grooves having ribs therebetween, wherein the series of grooves have a portion that narrows proximate the datum edge guide surface to define a distance between the datum edge guide surface and the edge guide when the roll assembly is loaded into the printer, and wherein the portion that narrows on the series of grooves narrows over a portion of the length of the grooves along the direction of roll feeding and is configured to more snugly receive the edge guide at the position along the direction of roll feeding at which the datum edge guide surface is provided than at a position along the direction of roll feeding upstream from where the datum edge guide surface is provided, thereby more tightly controlling a distance between the datum edge guide surface and the edge guide.

10. The media guide system of claim 1, wherein the plurality of edge guide receivers are essentially parallel to one another.

11. The media guide system of claim 1, wherein the plurality of edge guide receivers are formed in a surface that is orthogonal to the datum edge guide surface.

12. The media guide system of claim 1, wherein the datum edge guide surface is located proximate a platen roller in the guide base.

13. The media guide system of claim 1, wherein the guide base further includes a rear stop, the rear stop configured to support a portion of the edge guide of the roll assembly.

14. The media guide system of claim 1, further comprising a slot for feeding the roll out of the guide base.

15. The media guide system of claim 1, wherein the printer is a thermal transfer printer.

16. The media guide system of claim 1, further comprising an upper print frame containing a print head proximate a platen roller in the guide base when the upper print frame is in a closed position and the upper print frame is adjustable relative to the guide base to lift the print head from the platen roller and move the upper print frame into an opened position;

wherein, when the upper print frame is moved into the opened position, the guide base is exposed such that the roll assembly can be loaded into the guide base, a portion of the roll can be extended over the platen roller, and the upper print frame can be returned to the closed position to sandwich the roll between the print head and the platen roller.

17. The media guide system of claim 16, wherein the upper print frame has a portion for selective coupling to a top of the edge guide of the roll assembly when print frame is in the closed position, the roll assembly is secured within the print frame to prevent movement of the roll assembly within the print frame.

18. The media guide system of claim 1, wherein the datum edge guide surface is fixed relative to the plurality of edge guide receivers.

19. The media guide system of claim 1, wherein the plurality of edge guide receivers are grooves and the grooves have a portion that narrows at a location along the direction of roll feeding on a forward end of the groove nearest to the datum edge guide surface, thereby defining a distance between the datum edge guide surface and the edge guide when the roll assembly is loaded into the printer.

20. A media guide system for guiding media unwound from a roll of a roll assembly along a direction of roll feeding in a printer, the roll assembly having the roll supported by a core extending from one core end to an edge guide, the guide system comprising:

a guide base including:

a datum edge guide surface provided at a position along the direction of roll feeding; and a plurality of edge guide receivers formed in the guide base and extending continuously along the direction of roll feeding to the position along the direction of roll feeding at which the datum edge guide surface is provided; and the roll assembly, wherein, when the roll assembly is loaded into the guide base by engaging the edge guide into at least one of the plurality of edge guide receivers, the datum edge guide surface of the guide base and the edge guide of the roll assembly serve as edge guides to guide the media unwound from the roll through the printer during a printing operation, and wherein the edge guide receivers are located on a bottom wall of the guide base and the datum edge guide surface is located on a lateral wall of the guide base, the datum edge guide surface being a surface on the lateral wall which projects from another portion of the lateral wall, in a direction perpendicular to the direction of roll feeding, so that the datum edge guide surface is the closest surface on the lateral wall to the edge guide receivers.

* * * * *